United States Patent [19]

Terp et al.

[11] Patent Number: 4,919,352

[45] Date of Patent: Apr. 24, 1990

[54] WEB AND TRANSFER CUTOFF APPARATUS

[75] Inventors: Gerald W. Terp, Green Bay; Edward F. Stanek, Gillett, both of Wis.

[73] Assignee: Magna-Graphics Corporation, Oconto Falls, Wis.

[21] Appl. No.: 262,453

[22] Filed: Oct. 25, 1988

[51] Int. Cl.[5] ..... B65H 19/20

[52] U.S. Cl. ..... 242/56 A; 242/56 R

[58] Field of Search ..... 242/56 A, 56 R, 65, 242/66

[56] References Cited

U.S. PATENT DOCUMENTS

| | | | |
|---|---|---|---|
| 3,501,104 | 3/1970 | Hellemans | 242/56 A |
| 3,630,462 | 12/1971 | Nordgren | 242/56 A X |
| 3,642,221 | 2/1972 | Hellemans | 242/56 A |
| 3,848,824 | 11/1974 | Van Schijndel | 242/56 A |
| 4,171,780 | 10/1979 | Bugnone | 242/56 A |
| 4,326,679 | 4/1982 | Phelps et al. | 242/56 A |
| 4,326,680 | 4/1982 | Tetro et al. | 242/56 A |

*Primary Examiner*—Stuart S. Levy
*Assistant Examiner*—Steven M. duBois
*Attorney, Agent, or Firm*—Andrus, Sceales, Starke & Sawall

[57] ABSTRACT

A web rewind unit includes a turret with spaced spindles and cores for receiving the web. A slide is mounted on the turret beneath the web moving over the core at the winding station. A knife bracket is pivotally secured to the slide. A power cylinder positions the slide between a web cut position and a retracted position. A pivot unit connects between the knife bracket and the main cylinder unit. A pneumatic cylinder loads the pivot unit. A stop unit is mounted to the machine frame and includes an adjustable member for establishing angular orientation of the cutting knife to accurately locate the knife with respect to the web during the cutting action. An air bar is mounted above the web path and moves down through the web as the knife pivots. The free web end of the web moves into the new core. The air bar includes a cam which engages a cam roller on the bracket and pivots the knife to cut the web. The timing is preferably such that as the knife moves to the cutting position, the air bar cylinder is operated and the cam coupled to the knife bracket is engaged by the pivoting air bar and the knife blade pivots and moves through the web. The air bar moves through the web in a direction opposite the knife. The air blast drives the free end of the web downwardly into a guide about the new core.

18 Claims, 4 Drawing Sheets

WEB AND TRANSFER CUTOFF APPARATUS

BACKGROUND OF THE PRESENT INVENTION

This invention relates to a web cutoff and transfer apparatus and particularly to such apparatus for cutting and transfer of a moving web from a winding roll to a winding core unit.

In the processing of paper, film and like elements, a web of an indefinite length is often provided on a supply roll and rewound into one or more rewound rolls. The rewind apparatus is preferably constructed to maintain a continuous uninterrupted winding of the new rolls, including a cutoff and transfer mechanism for automatically cutting the web and transfering of the web from the end of rewound roll to a core means for the next rewound roll to be formed. Highly developed apparatus is commercially available for rewinding of paper, film and the like. A widely used cutoff and transfer apparatus includes a knife member mounted transversely of the web and suitably operated to move through the web. A cutter and transfer bar is provided to the opposite side of the web at the cutoff point. An air bar may be used to create a blast of air on the cut web to firmly support the web against the knife for rapid clean cutting and for promoting movement of the web onto the new core unit. Guide members are often also provided for guiding of the free end of the web onto the new core unit to promote a smooth wrapping of the web onto the core, after which it is tightly wound to assure a smooth, compact winding of the web into a roll.

In certain applications, different sized core units are used depending upon a particular winding specification. The diameter of the final wound roll may also vary from application to application. Generally, the cutoff blade and the cooperating cutting bar are desirably oriented in the same predesigned orientation at the moment of cutting the web. This is important not only to provide a smooth severing of the web but to properly locate the free end of the web immediately adjacent the core for movement onto the new core to initiate the new wrap. Further, the free end of the web should be placed on the core as a flat member, and essentially with a zero fold back of the free end. In many cutoff apparatus, the high speed movement of the web tends to cause the free end of the web to fold back on itself as it is being driven downwardly into the guides and onto the new core means. The fold back even where unacceptable is desirably minimized to produce a smooth, even roll.

In order to effect a very rapid and effective transfer with webs moving at high speed through the processing line, the knife must be accurately located and actuated in precise and rapid time relation to provide the desired repeatable and optimum cutting of the web.

SUMMARY OF THE PRESENT INVENTION

The present invention is particularly directed to a cutter apparatus constructed and mounted for accurately and repeatably locating a severing element from a standby position spaced from the winding station during the winding of the roll at the winding station to a cutoff and transfer position adjacent the winding stations for cutting and transferring the cut web onto a new core unit, and permitting essentially zero fold back in the optimum construction. Generally in accordance with the teaching of the present invention, the cutter apparatus includes a cutoff knife unit mounted in a linear moving support for selectively positioning of the knife unit between the cutoff position in close spaced relation to the core and a retracted position allowing the continuous winding of the roll. The knife unit includes a knife blade pivotally mounted to the support. The knife blade is pivoted at the precise moment of cutting the web to move rapidly through the web with the pivoting action. Simultaneously, a cutter bar, preferably an air bar, is moved downwardly through the web to direct the web across the sharp blade, with the free web end of the incoming web moving into engagement with the new core unit. The linear support and movement of the knife blade unit provides for precise repeatable location of the knife with respect to the web and the core means. The pivoting motion provides a rapid and effective cutting of the web. The cutter bar located to the opposite side of the web promotes the rapid and effective cutting of the web and movement of the free web end onto the new core with essentially zero fold back.

More particularly in accordance with a preferred construction of the present invention, the rewind apparatus includes a turret apparatus having circumferentially spaced spindle units for supporting rotating cores for receiving the web. A slide unit is mounted within the turret apparatus. A power cylinder unit is coupled to the slide unit and is operable to position the slide unit between a web cutting position and a retracted standby position. A knife bracket is pivotally secured to the slide unit and supports a knife blade which extends across the machine beneath the web path as the turret indexes a roll from the winding station. The bracket is supported by a pivot unit connected between the knife bracket and the main cylinder unit, and preferably includes a pneumatically loaded cylinder. A stop unit is mounted to the machine frame structure and located beneath the pivoting knife. The stop includes an adjustable member for establishing angular orientation of the cutting knife with respect to the periphery of the core and the movement of the web over the core. The stop accurately locates the cutting edge of the knife with respect to the movement of the web during the severing and cutting action. The linear movement of the knife unit moves the knife into the cutting position. The timing is preferably such that as the knife moves to the cutting position, the air bar cylinder is operated and the cam coupled to the knife bracket is engaged by the pivoting air bar and the knife blade pivots and moves through the web. Simultaneously, the air bar moves through the web. The timing is such that the air bar and the knife blade essentially engage and move in opposite directions through the web to effect a clean cut across the width of the web. The air blast drives the free end of the web downwardly into a guide about the new core to initiate the roll on the new core.

The present invention has been found to provide a highly effective cutoff and transfer apparatus particularly adapted to rewinding applications requiring different sized cores.

BRIEF DESCRIPTION OF DRAWINGS

The drawings furnished herewith generally illustrate the best mode presently contemplated for the invention and are described hereinafter.

In the drawings.

DESCRIPTION OF THE ILLUSTRATED EMBODIMENT

Figure 2:
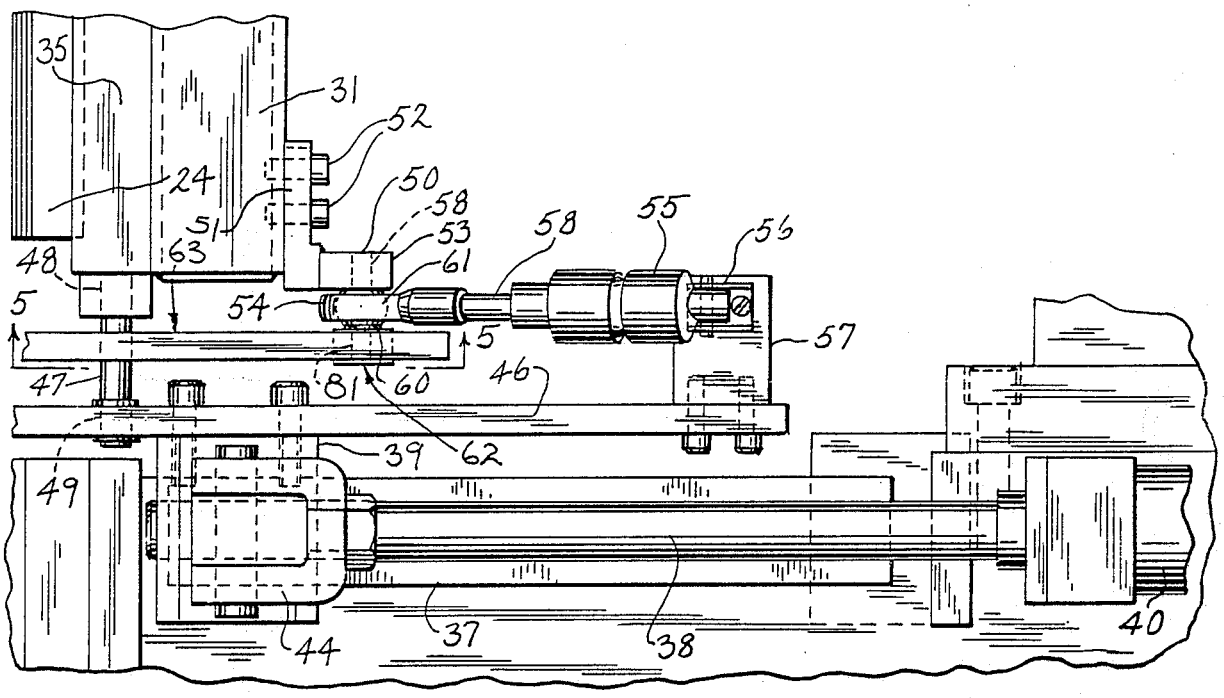
FIG. 2 is an enlarged plan-elevational view of the cutoff and transfer apparatus shown in FIG. 1.
Figure 1:
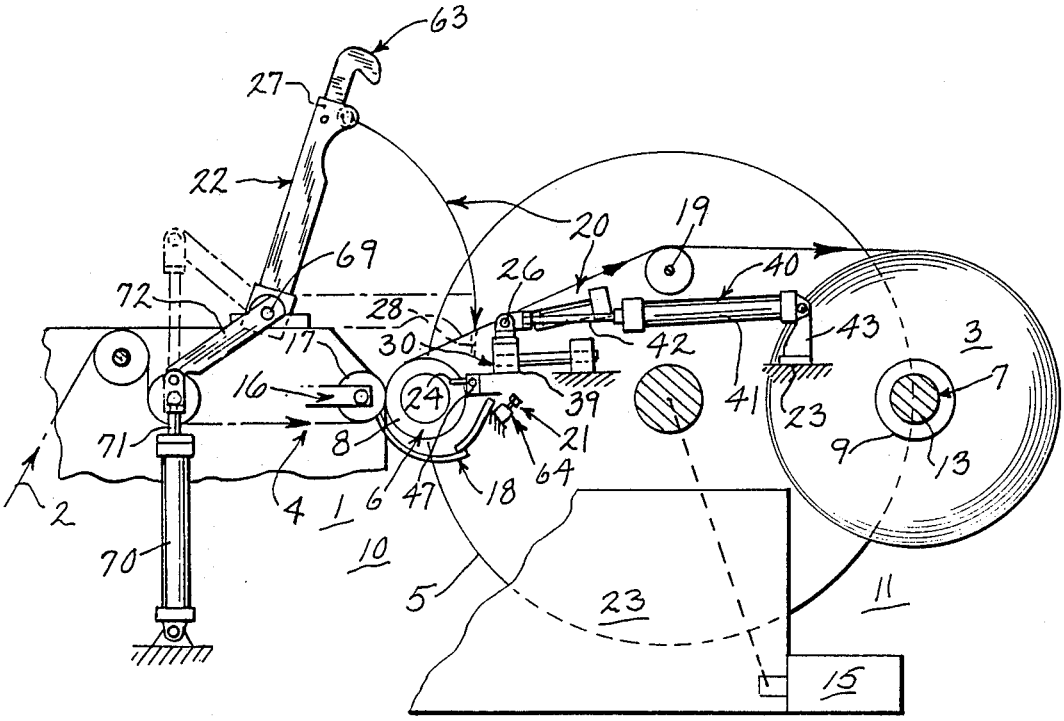
FIG. 1 is a diagrammatic view of a rewinding apparatus incorporating an automatic cutoff and transfer unit constructed in accordance with the teaching of the present invention

Referring to the drawings and particularly to FIGS. 1 and 2, rewinding apparatus 1 is illustrated for rewinding of an incoming web 2 from a web processing or converting machine, not shown. The web 2 is typically a coated or uncoated paper, film or other continuous web material which is to be wound into a roll 3. The rewind apparatus 1 includes an infeed apparatus 4 for feeding and guiding the web 2 to a rewind turret unit 5 under a controlled tension. In the illustrated embodiment, the turret is a dual unit including a pair of rewind core units 6 and 7 rotatably carried on diametrically opposite sides of a rotational axis of the turret unit 5. Each of the rewind core units 6 and 7 is identically constructed to releasably support an elongated tubular core 8 and 9 respectfully. The turret unit 5 supports the core units 6 and 7 in alternate positions generally in a substantially horizontal plane. The core unit 6 in the illustrated embodiment is shown located in an rewind stand or location or station 10 adjacent the infeed apparatus 4. The web 2 is to be wound onto the core 8 as the result of the rotation of the core 8. The second core unit 7, in the two core rewinders shown, is located on the turret spaced approximately one hundred and eighty degrees from unit 6, and is located at a load/unload station 11 for removing of a fully rewound roll 3, and replacing thereof with a new unwound core unit.

Each of the core units 6 and 7 includes spaced spindles 13, with an independent core drive motor, not shown, coupled to drive the one spindle and rotate the coupled core during winding of the web 2 onto the core. The spindles 13 releasably engage the opposite ends of the core 8 and 9 to support and rotate the core in accordance with known technology.

At the rewind location or stand 10, the rotation of the core 9 operates to wind the web 2 onto the core 9.

A turret drive motor 15 is coupled to the turret unit 5, as diagrammatically illustrated, to rotate the turret unit and thereby move the core units 6 and 7 between the rewind location or station 10 and the load/unload station 11 for successive formation of rewound rolls 3. The illustrated structure is a glueless type of a core winding system, and the free end of the web 2 must be wrapped onto the core 8 at the winding station 10 for at least a coupled of turns to capture the web onto the core after which the rotation of the core insures continuous winding of the web onto itself to form the rewound roll.

Web 2 is shown passing through apparatus 4 and over the core 8 of core unit 6 at the rewind station 10. A rider roll and guide unit 16 is located to the exterior side of the core unit 6 in the initial rewind position at the rewind station 10. The unit 16 includes a freely rotating rider roll 17 and a web guide 18. Unit 18 is selectively moved into a position near engagement with the core 8 and web 2 for guiding of the web onto the core during initial forming of a roll, and the rider roll establishes a continuous smooth wrapping of the web 2 into the roll 3.

Figure 3:
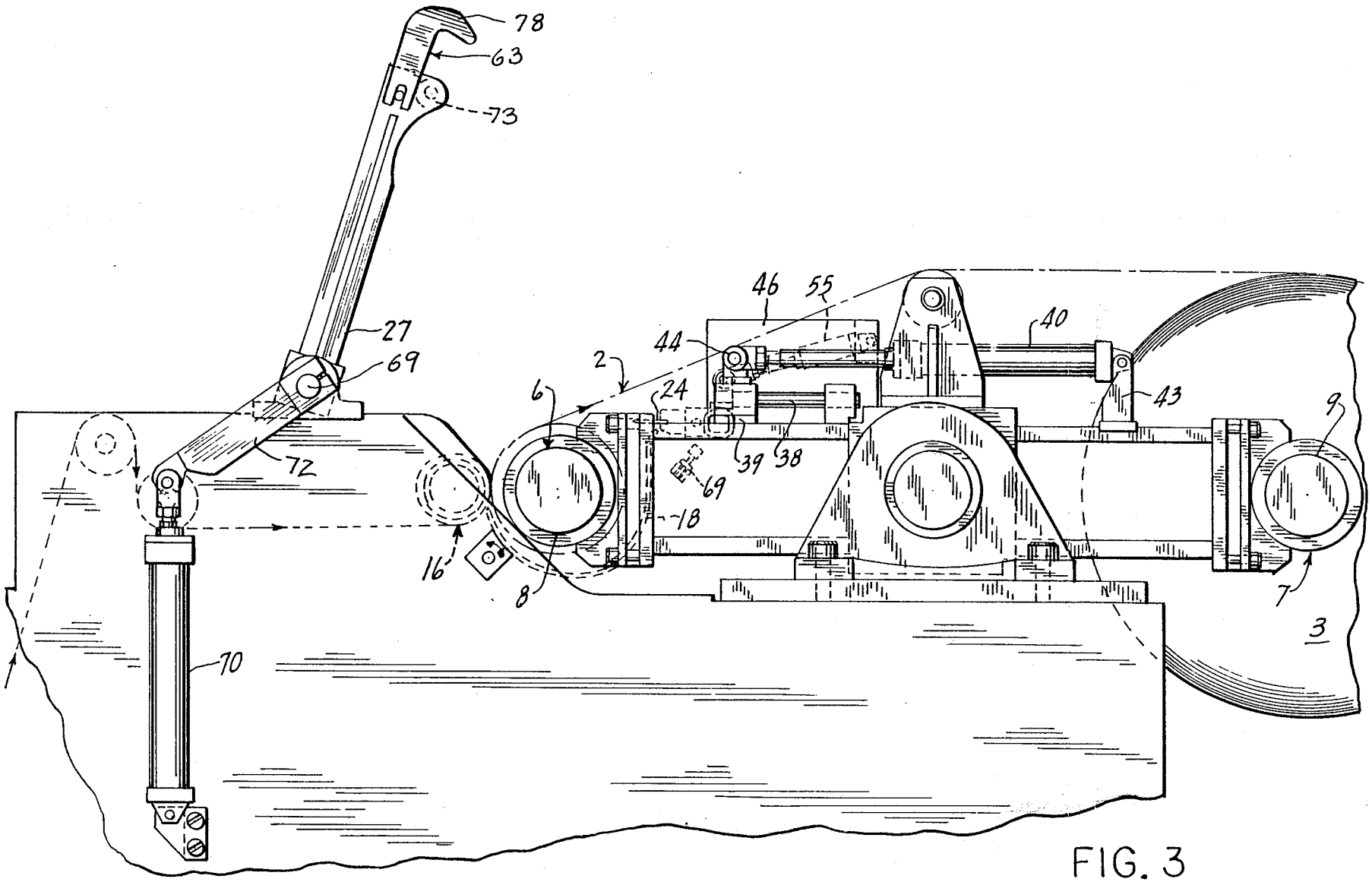
FIG. 3 is an enlarged side view of a part of FIG. 1.

After formation of a roll 3 and just prior to the completion of the formation of the roll, the turret unit 5 is rotated and indexed to carry the partially wound roll 3 toward the unload station 11, with the web 2 still attached to and being wound onto the roll 3, as shown in FIGS. 1 and 3. The roll 2 may require a predetermined number of wraps or layers, and the rewind apparatus may include a rotational counter to count the number of revolutions of the core unit or sense the diameter of the roll 3. One or more free-wheeling guide rolls 19 are secured to the turret between the core unit 6 and 7. The rolls 19 lift the web 2 upwardly from the rewind location or station 10 to receive new core unit 6, at which time the apparatus is essentially in the position shown in FIGS. 1 and 3.

The turret 5 thus indexes from the winding position to a transfer position, at which time the web 2 is severed adjacent to the new core unit 6, and the outer free end of the web 2 is transferred to the new core unit 6. A cutoff and transfer apparatus 20 is mounted adjacent the winding station 10 and includes a knife unit 21 and an air bar unit 22 located to the opposite sides of the web path as the web 2 is carried by the wound roll moving from the winding stator.

The knife unit 21 and the air bar unit 22 are mounted at the winding station 10, with the knife unit 21 between the side frames 23 of the turret unit 5. The air bar unit 22 is mounted exteriorly of the turret unit 5 adjacent the infeed system 4.

Figure 3A:
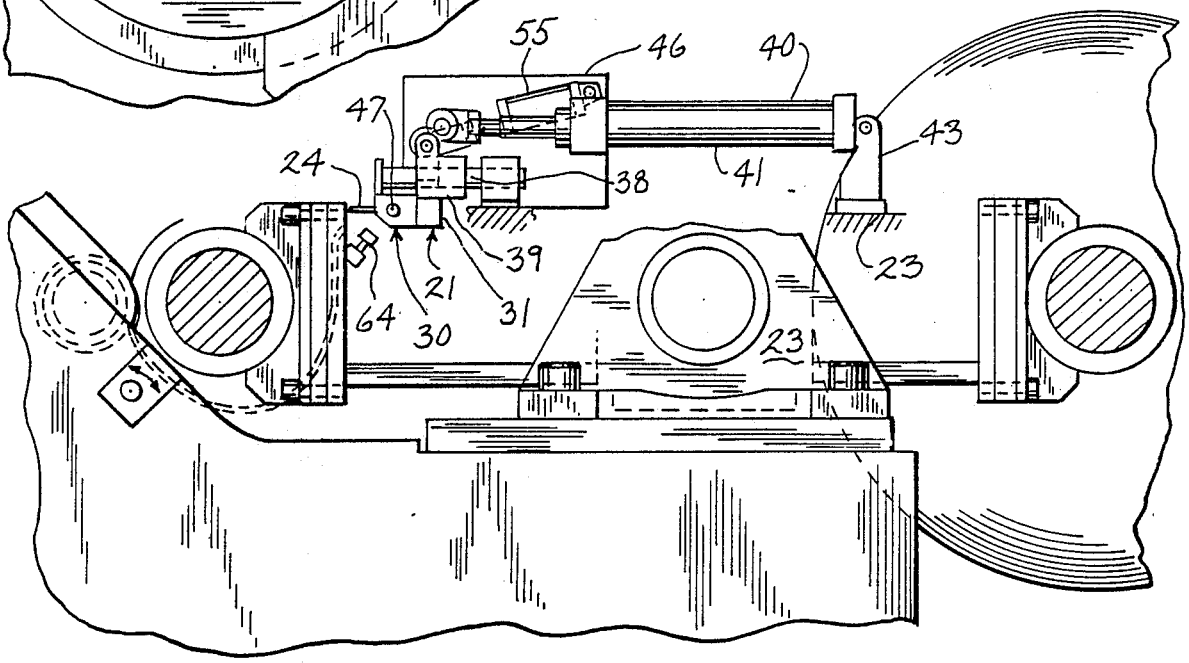
FIG. 3*a* is a fragmentary view similar to FIG. 3, with parts broken away to show certain detail of construction.
Figure 5:
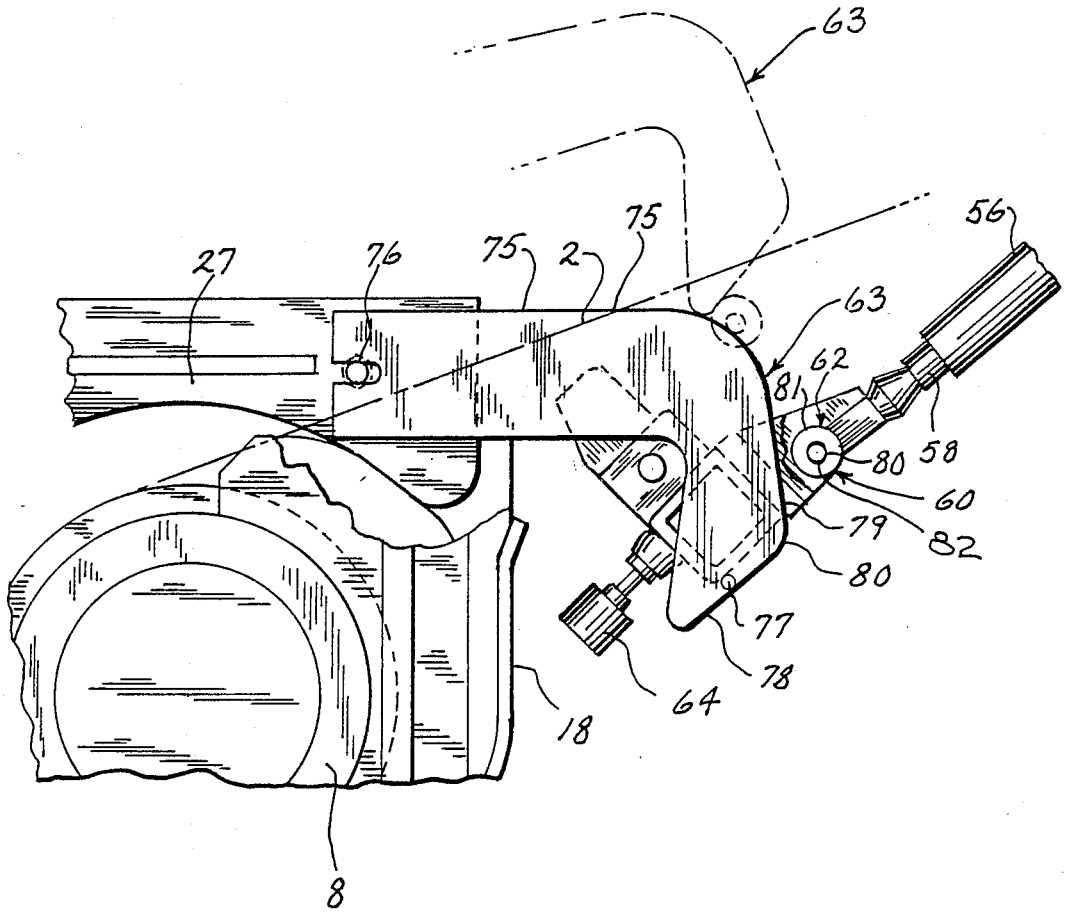
FIG. 5 is an enlarged sectional view taken generally on line 5—5 of FIG. 2.

The knife unit 21 is particularly located immediately downstream of the core location at the winding station 10 and beneath the web 2 which is moving over the new core unit 6 at the winding station 10 to the indexed rewound roll 3. The knife unit 21 includes a cutting blade 24 which extends completely across the web. The knife unit 21 is supported at the opposite ends on a support unit for both a linear and pivotal movement. The knife unit 21 is retracted during the winding of a roll 3 to the standby position (FIG. 3*a*) and moved to the cutting position during the indexing. At the time of web severing, the knife unit 21 is located to move the blade 24 through the web 2 with a pivoting motion.

The transfer air bar unit 22 includes an air bar 27 pivotally mounted to the opposite side of the web 2 and extended completely across the web 2. The air bar unit 22 is located to move a bar 27 through the path of web 2 between the new core unit 6 and the pivoting knife unit 21. The bar 27 is also constructed to form an air jet 28 which engages the web 2 upstream of the knife unit 21. The illustrated air bar unit 22 is pivotally mounted at the opposite ends.

Upon actuation of the knife unit 21 and the air bar unit 22, the web 2 is severed by the knife blade along a line running across the web The air bar 27 of air bar unit 22 pivots downwardly into engagement with the web 2 and deflects the web downwardly. Simultaneously, the knife 24 of the knife unit 2 pivots upwardly and passes through the web 2, slightly downstream of the air bar 27 and severs the web. The free end 29 of the severed web 2, with assistance from air jet 27*a*, moves onto the core, with guide unit 18 guiding the web about the core to start a new roll.

Upon transfer of the web, the air bar 22 is raised and the knife unit 21 is lowered and retracted to permit the winding of another roll at the winding station 10.

The roll 3 at station 11 is completed and replaced with a new core unit, and the cycle repeated.

Figure 4:
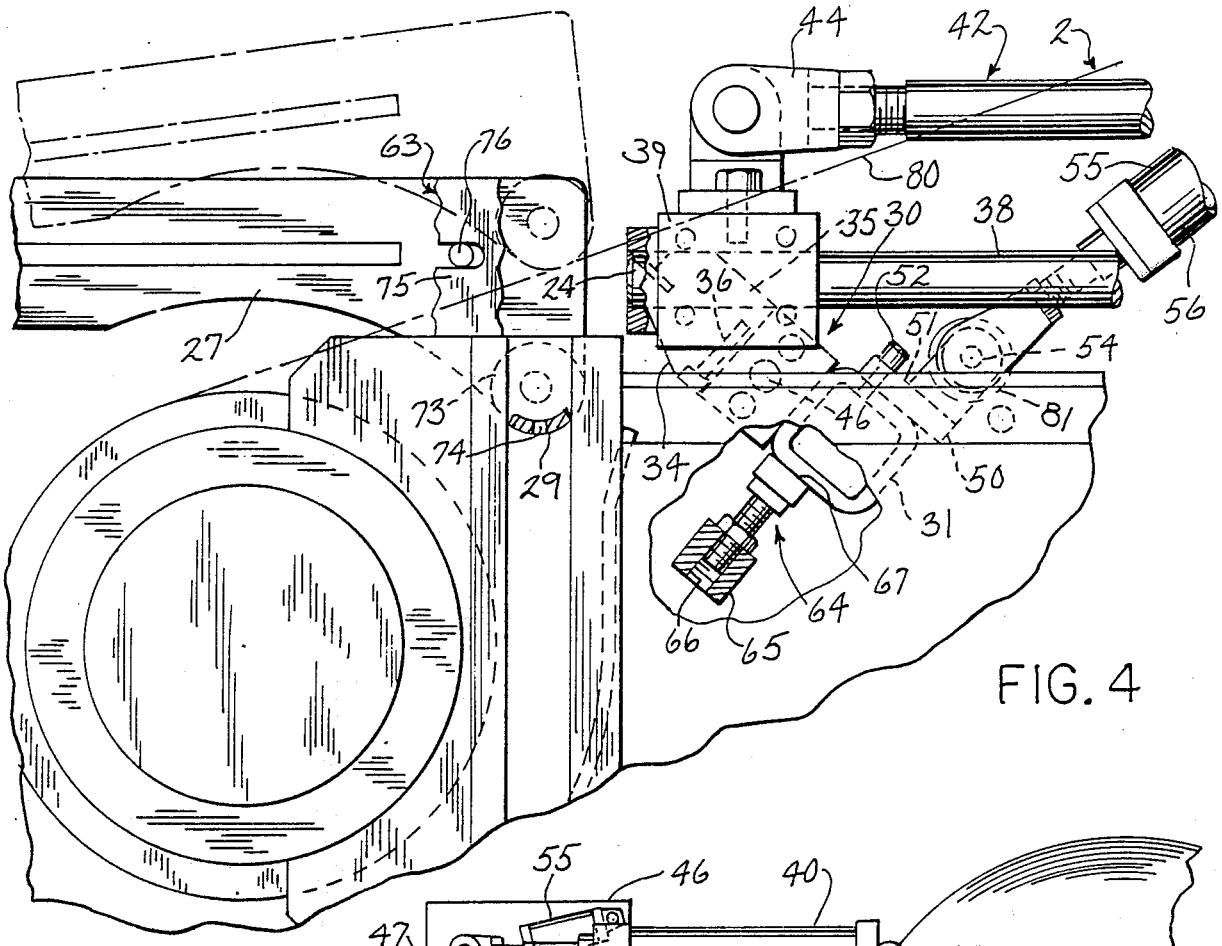
FIG. 4 is an enlarged sectional view illustrating the position of elements moving to the web cutting position.

More particularly, the knife 24, as more clearly shown in FIGS. 3 and 4, is releasably secured within a pivotal knife support structure 30 for the pivotal and linear movement. A box beam 31 is mounted in a support within the side arms of the turret unit 5. The knife blade 24 is clamped between a pair of clamp blocks 34 and 35 which are rigidly secured to the one wall of the beam 31 for movement therewith. In the illustrated embodiment of the invention, the one clamp block 34 is removable and secured to the fixed clamp block 35 by one or more bolts 36 to rigidly clamp the knife blade 24 projecting outwardly from the beam structure.

The beam 31 is pivotally mounted to a sliding support 37 to the opposite ends of the knife 24 and knife support beam. One of the supports is shown in FIGS. 2–4. The support at the opposite end of the beam is correspondingly constructed.

The illustrated sliding support 37 includes a slide rod 38 fixedly mounted to the machine frame within the turret unit 5. A slide member 39 is slidably mounted on the rod 38 with a roller bearing unit, not shown, within the slide member 39 providing a low friction support of the beam 31 on the rod. A power cylinder unit 40 is provided to the one side of the machine in-line with the slide rod 38, as shown in FIGS. 1—3. The power cylinder unit 40 includes a cylinder 41 and a piston rod 42 projecting therefrom. The cylinder 41 is mounted to the machine frame 23 by suitable bracket 43 with the piston rod 42 projecting forwardly in vertically spaced alignment with the guide slide rod 38. The outer end of the piston rod 42 is pivotally affixed to the slide member 39 by a pinned clevis connector 44. A beam support plate 46 is bolted or otherwise rigidly fixed to the side of the slide member 39.

The opposite ends of the knife block 35 are pivotally secured to the pivot support plate 46 at the opposite ends of the beam 31 by similar and aligned pivot pins 47. Referring particularly to FIG. 2, the pin 47 is fixed to knife block 35 as by a threaded shank 48 and projects laterally therefrom. The outer end of the pin 47 is journaled in a bearing opening in the support plate 46 for pivoting of the knife and beam assembly.

As most clearly shown in FIGS. 2 and 4, a pivot bracket 50 is secured to the one end of the beam 31. The bracket 50 is shown as a L-shaped member having one leg 51 bolted to the back wall of the beam as at 52. The second leg 53 of the L-shaped bracket 50 is connected to a universal pivot unit 54. A pneumatic cylinder unit 55 is attached to the support plate 46 and to pivot unit 54. The cylinder unit 55 includes a cylinder 56 which is secured by clevis connector 56*a* to a bracket 57 bolted to one side of the plate 46. The piston rod 58 of the cylinder unit 55 is pivotally secured to the second leg 53 of the bracket 50 by the pivot unit 54. The unit 54 includes shaft 58 threaded into the leg 53 with an outer ball 60 located within a spherical opening in a rod connector 61. The cylinder unit 55 pneumatically loads and biases the knife 24 about pivot pin 47 between a horizontal position for sliding of the knife 24 into spaced position the web path 2 at a time for cutoff and transfer of web 2 and a pivoted cutting position as follows.

The knife pivot unit 54 includes a cam follower 62 located in the path of a cam 63 secured to the outer end portion of air bar unit. As the air bar pivots down, the cam 63 engages the cam follower 62 and mechanically forces the cam 63 attached knife unit to move and pivot the knife unit about pin 47.

A stop member 64 is fixed to the machine frame beneath the cutoff knife 24 at the cutoff location to limit the pivoting of the knife unit by the cam 63. In the illustrated embodiment of the invention, the stop 64 includes a support bracket 65 secured to the frame. The stop member 64 is secured to the outer end of a threaded bolt 66 which threads into an appropriate threaded opening in the support bracket 65. The stop projects upwardly and outwardly with respect to the core unit 6 at the winding station 10, with the stop wall 67 in a plane generally perpendicular to the plane of the web 2 as it moves from the core unit 6 onto the rewound roll 3. The knife 24 is located by the stop wall in a proper angle projecting upwardly and toward the web, with the knife edge located downstream of the core and below the web path just prior to cutting of the web 2. The threaded adjustment of the stop member 64 changes the angular orientation of the knife edge 24 with respect to the web to adjust for various diameter core means.

The knife 24 is located in close proximity to the new core unit 6 and at cutoff and as it pivots through the web 2 is at the proper angle to establish a minimum free end and fold back of the web 2 as it transfers onto the new core unit.

The air bar unit 22 and particularly air bar 27 is pivotally mounted to the machine frame as at 69. A power cylinder unit 70 is mounted to the frame and has a piston rod 71 connected by lever 72 to the pivot shaft of the pivot unit 69. The retracted piston rod 71 pivots the bar 27 upwardly to a vertical position spaced from the core unit and roll at station 10. Extension of rod 71 pivots lever 72 and bar 27 downwardly with the outer nose end of the bar 27 moving through the path of the web 2 and into the opening of guide 18. The outer nose end of bar 27 has a generally projecting cylinder portion within which an air pipe 73 is located. The pipe 73 has a series of spaced discharge openings 74 for establishing the air blast 28 for forcing the severed web end 29 into the guide 18 and about the core 8 at station 10, after which the unit 22 is retracted during which movement the knife unit is pivoted to the horizontal sliding position and then retracted.

The cam 63 on the end of the unit 22 is preferably constructed as follows. A plate 75 is bolted as by bolts 76 to the outermost end of arm 27 and is formed with an integral curved end face defining the positioning cam 63. The cam 63 includes a generally flat cam edge 77. The plate 75 is L-shaped with the outer leg depending downwardly of the air bar.

The depending leg has a curved bull-nose configuration defining an inclined cam surface or portion 78 merging with a straight cam portion 79 inclined slightly backwardly toward the air bar unit, with a smooth curved connecting portion 80. The cam follower 62 is shown as a roller 81 mounted on a shaft extension 82 of the shaft 58. The roller 81 is freely rotated to provide a low friction engagement with the cam 63 during movement of the web transfer. Thus, at the time of transfer, the cam 63 rotates or pivots with arm unit 22 downwardly and the inclined portion 78 engages the follower roller 81, which rides outwardly and downwardly with the continued pivoting of the arm unit and past the curved portion 80 to the portion 79. The pivoting movement of the arm and cam 63 loads the pneumatic cylinder unit 55. As the follower 62 moves over the portion 80 and onto portion 79, the cam moves as a result of the pivoting about the arm axis, from a maximum radius and thus releases the cylinder unit 55 which expands and pivots the knife unit through the cutting position. The stop member in the path of the knife unit limits the pivoting motion and the cam follower 62 is preferably spaced from cam 63 in the final position to establish unrestricted knife pivoting during the cutting action. Upon resetting of the arm unit, the cam 63 pivots upwardly and the cam portions and 80 move outwardly and upwardly into engagement with the follower roller 81, forcing the roller and attached cylinder rod unit outwardly and upwardly including pneumatic loading of the cylinder. As the portion 80 moves past the cam follower roller 81, the cylinder unit expands and the roller moves along the inclined portion 79 to the original standby position for sliding movement as the cam 63 moves from the cam follower 62. The knife unit is retracted and the winding of the new roll proceeds until the next cutoff and transfer period, at which time the cycle is repeated.

In summary, the lowermost end of the cam edge engages the roll of the pivot unit as the air bar 27 moves to engage the web. Continued movement of bar 27 forces the cam edge past the cam follower and forces the cam follower down and out. The movement of cam follower is constrained by the pneumatically loaded cylinder and the pivotal mounting of the cylinder unit and the knife unit, the cam follower, and attached knife unit pivoted about the pin following the path.

In operation, the linear-moving cylinder unit 40 is actuated to position the knife unit 21 in a retracted position, located in outwardly spaced relation to the winding station. (FIG. 3*a*) In this position, the roll 3 can be wound at the winding station to any desired specified diameter within the limits of the winding apparatus.

The cam moves the cam follower and compressed the loading cylinder as the knife unit pivots about the pivot pin. The cam follower moves over a center position and the loaded cylinder expands as the cam edge moves from the cam follower. The cylinder rapidly pivots the knife unit with the blade passing through the web as the bar moves through the web path.

When the roll approaches its final wound state, the turret 5 is indexed to move the rewound roll 3 from the winding station 10. During the first portion of the indexing time, the web 2 is still being wound onto the rewound roll 3 from the winding station 11 to finish the roll. Simultaneously, the indexed turret 5 moves a new core unit 6 into position at the winding station 10, with the rider roll unit 17 including the guide structure 18 moved into the initial winding position. The linear power cylinder unit 40 is actuated to move the knife 24 into the cutting position. (FIGS. 1 and 3) At this time, the knife 24 is pivoted downwardly and located in a horizontal plane and in spaced relation to the web 2, and with the cutting edge just above the guide 18, as shown in FIGS. 1 and 3. At the time of cutoff, a suitable control actuates the air bar cylinder unit 22. As the result, there is a clockwise rotation of the cutting knife 24 through web 2. The air bar 26 pivots downwardly with the cam engaging the follower to load the knife cylinder, and then engages the web and simultaneously releases the knife unit. The knife unit pivots upwardly as the cylinder unit expands and the air bar forces the web over the blade with the knife blade 24 severing or shear cutting of the web. The tail end 80 of the web 2 is wound onto the rewound roll as the final turns. The free end 29 of the incoming web 2 moves downwardly as a result of the rotating core 8 and the air blast 29 from the air bar 27 onto the core, where it is directed through the multiple member guide onto the core 8 to insure the wrapping about the core 8 to initiate a new rewound roll.

During the cutting operation, a slight gap is created between the blade edge of knife unit 21 and the air blast from the air bar 27. The outermost portion of the free end of the incoming web 2 may tend to fold back on itself forming a small fold-back portion, not shown, which would be trapped within the first layer wrapped on the core. In a practical environment, the fold-back is not a sufficient disruption to interfere with the creation of an acceptable rewound roll.

The illustrated embodiment of the invention includes various preferred constructions and embodiments of the invention to disclose the sequential linear and pivoting of a cutting blade. Various other embodiments using different powered and acting devices may be used and are encompassed within the means and devices set forth in the claims. For example, suitable separately powered devices may replace the cam mechanism shown for pivoting the knife blade. Similarly, the air bar unit provides a particularly effective transfer assistance and various other structures providing the desired web cutting movement and web transfer functions that may be used and are encompassed within the means and devices set forth in the claims. Further, the two features as shown and described may be individually used with other known or suitably constructed devices with the disclosed features and are within the scope of the means and functionally define devices of the claims.

Various modes of carrying out the invention are contemplated as being within the scope of the following claims particularly pointing out and distinctly claiming the subject matter which is regarded as the invention.

I claim:

1. In a web winding apparatus having a rotating turret means including a plurality of core support means circumferentially spaced about the turret means, means for rotating said turret means to sequentially move the support means between a winding station and an unloading station, means for guiding a web about the support means at the winding station, said core support means moving vertically and laterally from said winding station to said unloading station, a knife unit having a knife support means mounted for linear movement toward and from said winding station and located in an operative cutting position adjacent said web downstream of said support means with said knife support means positioned at said winding station, said knife unit including a knife member pivotally mounted to the knife support means, and power drive means for pivoting said knife member through a cutting motion and severing said web.

2. The apparatus of claim 1 including a cutting bar unit mounted to the opposite side of said web path from said knife unit, and means to move the bar unit downwardly through the web path in timed relation to the pivoting of said knife member.

3. The apparatus of claim 2 wherein said bar unit includes an air bar having means to establish an air blast directed through said web path, said air blast engaging and forcing the web over the knife.

4. The apparatus of claim 3 wherein said air bar in the downward position of said bar unit being located between the core support means and the knife member.

5. The apparatus of claim 3 wherein a cam unit includes first and second cam members secured to the knife unit and to the cutting bar unit and engaged during the movement of the bar unit to pivot the knife as the air bar unit moves through the web path.

6. The web winding apparatus of claim 1 wherein said knife support means includes a guide rod, a knife slide slidably mounted on said guide rod, a pivot unit connecting said knife member to said slide, said power drive means includes a cylinder unit coupled to said knife member and said slide for pivoting said knife member. --

7. The web winding apparatus of claim 1 wherein said power drive means includes a cylinder unit connected between said knife member and said knife support means for pivoting said knife member, and means to move said knife member to load the cylinder and suddenly release the knife member whereby the knife member rapidly pivots through the web.

8. The web winding apparatus of claim 1 wherein said knife support means includes a slide guide extending outwardly from said winding station, a slide mounted to said guide, a pivot unit secured to said slide, said knife member being secured to said pivot unit.

9. The apparatus of claim 8 including motor means connected to position said slide, and said power drive means includes a pivot drive cylinder unit connected between said motor means and said pivot unit.

10. The apparatus of claim 8 including an air bar pivotally mounted to the opposite side of the web from said knife member and pivoted downwardly through the web upstream of said knife member, said air bar including a cam unit adapted to engage the knife member to pivot the knife member to load the drive cylinder unit and release the knife member to pivot the knife member, said air bar establishing a blast of air engaging the web and forcing the web over the knife member simultaneously with pivoting of the knife member and the severed web onto the core unit.

11. A winding apparatus for successive winding a continuously moving web into a plurality of rolls, comprising a core support means including a plurality of rotating support means each constructed for receiving the web and winding the web into a roll, means for locating said core support means for receiving said web in a first initial winding position and in an outwardly spaced final winding position, a knife means for severing said web from said support means and located between said initial and final winding positions and forming a free web end applied to the core support means at said initial winding position, a sliding knife support mounted to move adjacent said initial winding position into a cutting position adjacent the web and to move from said initial winding position to permit build up of the web at said initial winding position, pivot means connecting said knife means to said sliding support, and power means to establish a pivotal movement of said knife means into cutting engagement with said web to sever the web.

12. The winding apparatus of claim 11 wherein said support includes a linear slide means to place the knife into said cutting position with said knife spaced from the web prior to cutting the web.

13. The apparatus of claim 11 wherein said power means is connected to pivot the knife from said cutting position after cutting the web for movement from said initial winding position.

14. The winding apparatus of claim 13 wherein said knife in the cutting position is located immediately adjacent the core to sever the web adjacent the upper side of the core and form a slight fold in the severed end of said web, said web moving onto said core with said slight fold in the severed end of the web applied to the core.

15. A winding apparatus for successive winding a continuously moving web into a plurality of rolls by the web over a rotating roll and severing the web downstream of the core means to transfer the web to the core means, comprising, a knife means for severing said web located between said core means and said rotating roll, a sliding knife support having a substantially straight line movement and mounted to move toward and away from said core means and having a cutting position adjacent said core means to cut the web and to move from said core means to permit build up of the web on said core means, movable means connecting said knife means to said sliding support, and including means to move the knife laterally of the movement of said sliding support, and powered means to sequentially move said support to the cutting position and then move said knife means laterally into engagement with said web to sever the web.

16. The winding apparatus of claim 15 wherein said moveable means includes a pivot means connecting the knife means to the support, and having a power means connected to the knife means and to the support for pivoting said knife means into engagement with the web, and means to load the power means and release the power means to pivot the knife through said web. pg,20

17. The winding apparatus of claim 15 wherein said knife in the cutting position is located immediately adjacent the core to sever the web adjacent the upper side of the core, and having a bar mounted to move through said web path and thereby move the web over the knife.

18. The apparatus of claim 15 wherein said powered means includes a linear moving element connected to said support with one position locating said support into cutting position with the knife means at the cutting position prior to cutting said web and having a pivot member coupled to said knife means to pivot the knife means through said cutting position and said linear moving element after cutting the web the support being retracted to a second position spaced from the cutting position.

* * * * *

UNITED STATES PATENT AND TRADEMARK OFFICE

CERTIFICATE OF CORRECTION

PATENT NO. : 4,919,352

DATED : April 24, 1990

INVENTOR(S) : GERALD W. TERP ET AL

It is certified that error appears in the above-identified patent and that said Letters Patent is hereby corrected as shown below:

Claim 3, col. 8, line 68, after "knife" insert -- member --;

Claim 12, col. 10, line 5, before "support" insert -- core --; Claim 12, col. 10, line 5, after "support" insert -- means; Claim 15, col. 10, line 19, between "by" and "the" insert -- winding --;

Claim 16, col. 10, line 42, after "web" delete "pg,20"; Claim 18, col. 10, line 56, after "web" delete "the support".

Signed and Sealed this

Fourth Day of August, 1992

*Attest:*

DOUGLAS B. COMER

*Attesting Officer*

*Acting Commissioner of Patents and Trademarks*